United States Patent [19]

Sakamoto et al.

[11] 4,065,741

[45] Dec. 27, 1977

[54] THERMAL FUSE WITH A FUSIBLE TEMPERATURE SENSITIVE PELLET

[75] Inventors: Yoshimasa Sakamoto, Otsu; Sadayoshi Iwanari, Kusatsu; Osamu Umene, Otsu, all of Japan

[73] Assignee: New Nippon Electric Co., Ltd., Osaka, Japan

[21] Appl. No.: 782,415

[22] Filed: Mar. 29, 1977

[51] Int. Cl.[2] ..... H01H 37/76

[52] U.S. Cl. ..... 337/407; 337/409

[58] Field of Search ..... 337/407, 408, 409, 410, 337/411, 414

[56] References Cited

U.S. PATENT DOCUMENTS

| | | | |
|---|---|---|---|
| 2,934,628 | 4/1960 | Massar et al. | 337/409 |
| 3,180,958 | 4/1965 | Merrill | 337/409 |
| 3,821,685 | 6/1974 | Kimball et al. | 337/409 |

*Primary Examiner*—George Harris

*Attorney, Agent, or Firm*—W. G. Fasse; W. W. Roberts

[57] ABSTRACT

The present thermal fuse comprises an electrically and thermally conductive housing for hermetically sealing the switching parts and a fusible, temperature sensitive pellet in said housing. The pellet is preferably molded to have a cylindrical shape or body provided with one cavity or several cavities and assembled in the housing, whereby the outside pellet surface contacts the inner surface of the housing. The cavity or cavities take up about 5 to 50 percent of the whole cross sectional area of the pellet. The pellet is made of a mixture of organic and inorganic substances preferably so as to accelerate the fusing function of the pellet when the temperature rises above the melting point of the major component of the organic materials. The cavity or cavities of the pellet greatly facilitate a large and rapid shrinkage in volume and the addition of inorganic substance provides a large thermal conductivity of the pellet, whereby a rapid and exact fuse action is accomplished.

6 Claims, 10 Drawing Figures

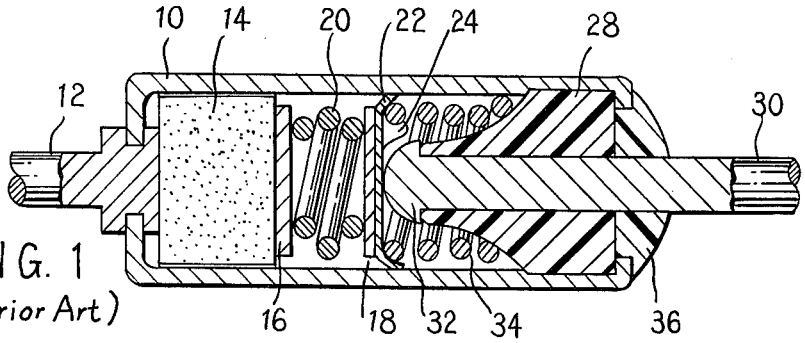
FIG. 1
(Prior Art)
FIG. 2
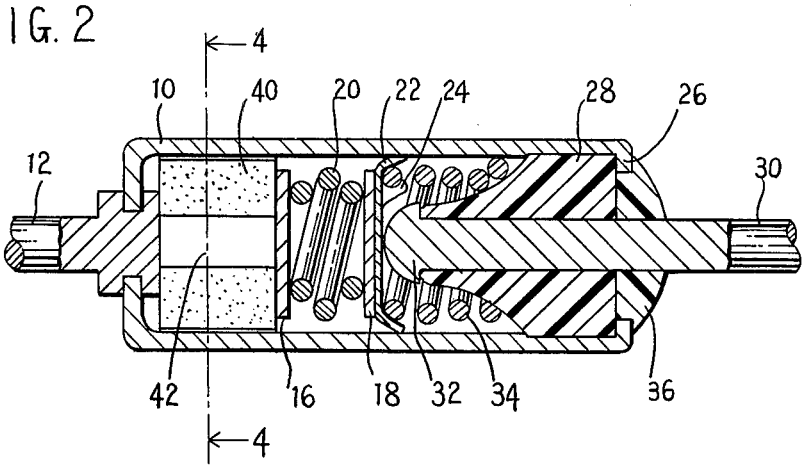
FIG. 3
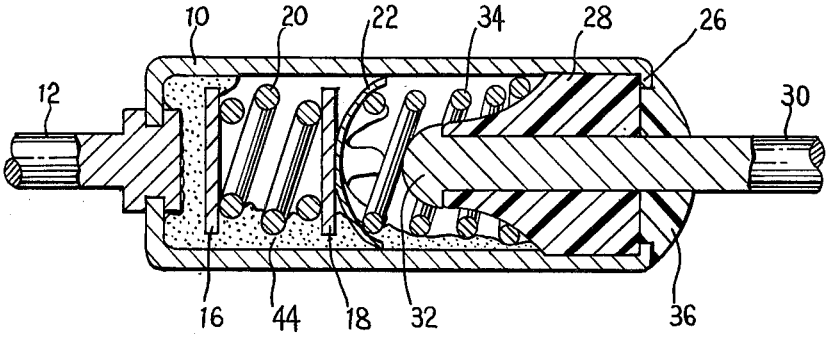

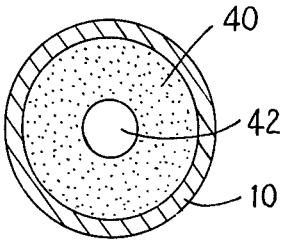
FIG. 4
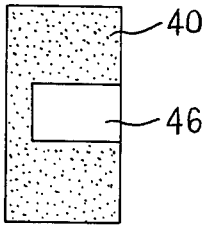
FIG. 5
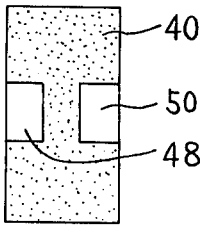
FIG. 6
FIG. 7
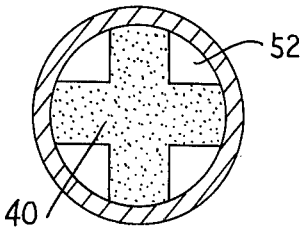
FIG. 8
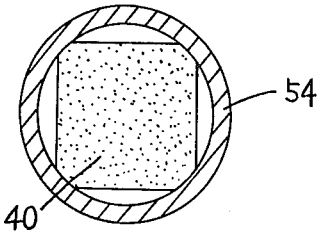
FIG. 9
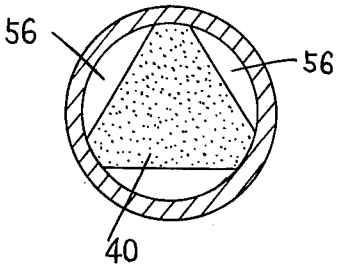
FIG. 10
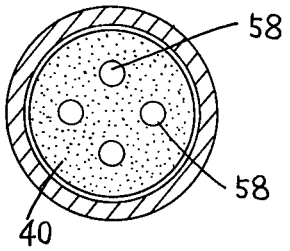

THERMAL FUSE WITH A FUSIBLE TEMPERATURE SENSITIVE PELLET

BACKGROUND OF THE INVENTION

This invention relates to a temperature responsive electric fuse or switch of the non-reset type, operable to open a circuit at a specific temperature. More particularly, the invention relates to an improvement of a temperature sensitive pellet for a thermal fuse, the reliability of which is improved by a sensitive and rapid temperature response characteristic at a specific temperature.

It is known to use overheating prevention devices to open a circuit when the temperature of an electric apparatus exceeds a given range, to increase the safety of the apparatus. Conventionally, such overheating preventing devices include two well-known types. One type is the non-reset type thermal fuse, employing temperature sensitive materials fusible at a specific temperature. Another type is self-resetting and uses bimetal thermocouple means. The bimetal-type is disadvantageous, in that even when it once functions to open the circuit, a drop in the ambient temperature allows the device to reset and start the current flow again. The switch-off and switch-on operation may thus be repeated unless the power supply is cut off, or the cause of the fault is eliminated. Thus, heat may be gradually stored in the bimetal device, whereby the temperature response of the device may be changed.

Recently, the non-reset type thermal fuse which employs an organic temperature sensitive pellet has been widely used due to the advantage of a constantly stable function over long periods of time in the absence of external changes in comparison with thermal fuses employing fusible metals. Such organic pellet fuses do not store any heat due to its non-reset characteristic, whereby the desired safety results.

This kind of thermal fuse of the non-reset type is described, for instance, in U.S. Pat. No. 3,519,972. FIG. 1 shows such a conventional thermal fuse with a cylindrical housing 10, made of a metal having a good electrical and heat conductivity. A first lead-in wire 12 is connected to one end of the housing 10. The switching elements include a temperature sensitive pellet 14, metallic disks or plates 16 and 18, two types of compression spring means 20 and 34 arranged within the housing 10, and a resilient slidable contact member 22, the peripheral portion 24 of which abuts against the inner wall of the metallic housing 10. These elements and an insulator 28 are enclosed by means of a housing edge 26. A second lead-in wire 30 passes through a further insulator 36 which hermetically seals the housing. Two different compression springs 20 and 34 are combined so that one of the springs has a greater resiliency than the other, while the other spring has a greater restoring force than the former. The second lead-in wire 30 has a head portion 32 forming a contact. A more detailed description of the prior art fuse and its function may be had from the above patent.

If the temperature at which the fuse is supposed to operate is, for example, 130° C, such a substance as fructose is used for the pellet. If the temperature is 145° C, glucose is used and if the temperature is 155° C, salicylic acid is used for the pellet, to give but a few examples. The organic substance, which is used to prepare the temperature sensitive pellets, is first pulverized into a powder which is then molded into pellets by a press molding.

However, the thermal conductivity of the pellel 14 is not always good. Moreover, the transmission of thermal energy always occurs from the outside of the pellet inwardly and through the cylindrical housing 10. Thus, even if the outside of the pellet should melt, its center may remain solid. As a result, it happens sometimes that the slidable contact member is not separated from the head portion of the second lead-in wire and the electric circuit is not interrupted. Moreover, since the melting of the temperature sensitive pellet occurs gradually from the outside inwardly, the slidable contact member is in an unstable state during the meeting. Thus, even if the slidable contact member is still separated from the second lead-in wire, the distance between the contacts is small enough to cause sparks, and the current is never fully interrupted. This is a serious disadvantage of the conventional temprature temperature pellet.

The conventional temperature sensitive pellet of the above fuse is made of an insulating organic material and molded under the proper pressure to form, for example, a cylinder of fine grains of said organic materials which are disclosed in U.S. Pat. No. 2,934,628. This kind of material must be selected in accordance with the particular use for which the thermal fuse is intended. Besides, it is difficult to reduce the costs of this prior art, small-sized thermal fuse, because it is hard to prepare the selected fine grains of organic materials.

OBJECTS OF THE INVENTION

In view of the foregoing, it is the aim of the invention to achieve the following objects, singly or in combination:

to improve a thermal fuse of the above type to avoid the deficiencies of the prior art, more specifically, to provide temperature sensitive pellets for such fuses which are capable to melt rapidly and exactly at a given temperature when the temperature of the housing rises;

to provide an improved temperature sensitive pellet which is molded with a cavity means to provide a large and rapid shrinkage in volume when the pellet is melting, whereby simultaneously the quantity of material for each pellet is substantially reduced;

to provide an improved temperature sensitive pellet which is manufactured by adding inorganic substances superior in their thermal conductivity and in their electrical insulation ability; and to make a pellet for a thermal fuse having a reliable and accurate response characteristic, of materials including inorganic substances and to shape the pellet as a cylinder having inner cavities such as a central hollow.

SUMMARY OF THE INVENTION

According to the invention, there is provided a temperature responsive electric thermal fuse or switch comprising a metallic, preferably cylindrical housing having one open end, a first conductor member or lead-in wire electrically fixed to the housing, a temperature sensitive pellet fusible at a predetermined temperature, retaining plates held opposite to each other by first compression spring means having a comparatively strong resiliency and a short stroke, a slidable resilient contact member having a central contacting portion and a plurality of peripheral contacting portions, second compression spring means having a comparatively weak resiliency and long stroke, an insulator for closing the open end of the housing, a second conductor member or lead-in wire passing through the insulator material and having at the tip a contact portion, and insulating sealing means for hermetically sealing and fixing the housing, the insulator and the second lead-in wire to each other, wherein the temperature sensitive pellet contacts the inner wall of the housing and provides fuse action accelerating means when the housing temperature rises to a given point. The fuse action accelerating means of the temperature sensitive pellet comprise at least one means for reducing the volume of the melting pellet material by forming cavity means in the pellet before it is installed in a fuse. The thermal conductivity of the pellet is increased by adding a small amount of inorganic materials to the mixture of the pellet material. Particularly, the improvement of the present invention is characterized in that the temperature sensitive pellet is manufactured in such a manner that the cavity means, for example, in the form of a central hollow has a cross sectional area of 5 to 50 percent, preferably 20 to 30 percent of the total sectional area of the pellet. Such cavity portion saves materials and yet provides the mechanical strength which is necessary for the pellet in the housing. The addition of insulating inorganic materials such as powdered alumina to the above pellet improves the thermal conductivity of the pellet, thereby accelerating a desired fusing of the pellet and also providing a desired, rapid shrinkage in the pellet volume upon melting.

BRIEF FIGURE DESCRIPTION

In order that the invention may be clearly understood, it will now be described, by way of example, with reference to the accompanying drawings, wherein:

FIG. 1 is a longitudinal section showing a thermal fuse of the prior art in a circuit closing condition;

FIG. 2 is a longitudinal section showing a thermal fuse of an embodiment of the present invention in a circuit closing condition;

FIG. 3 is a longitudinal section showing the fuse of FIG. 2 in its circuit breaking condition after the pellet has melted;

FIG. 4 is a cross sectional view of a pellet employed in the thermal fuse of FIG. 2 taken along the line 4—4 in FIG. 2.

FIGS. 5 and 6 illustrate longitudinal sectional views of different pellet configurations compared to FIG. 2; and FIGS. 7 to 10 each show a different cross section of further modifications of a pellet according to the invention.

DETAILED DESCRIPTION OF PREFERRED EXAMPLE EMBODIMENTS

Referring to the drawings, FIGS. 2 and 3 show longitudinal sections of different states of the temperature responsive electrical fuse or switch of an embodiment of the present invention, wherein the same elements of the conventional thermal fuse as shown in FIG. 1 are provided with the same reference numbers. The thermal fuse of the present invention comprises a cylindrical electrically and thermally conductive housing 10 made of metal, such as copper. The first lead-in wire 12 made of electrically conductive copper, or the like, seals one end of the cylindrical housing. Within the housing 10, there is a temperature sensitive pellet 40, which fuses at a given temperature. The pellet 40 is molded under proper pressure to form, for example, a cylinder having a hollow cavity 42. The pellet 40 is made of fine grains of an organic substance, such as anhydrous phtalic acid, salicylic acid, levulose, and/or glucose. The first compression spring 20 is inserted under compression between the disc-like metallic plates 16 and 18, made of electrically conductive copper. The slidable resilient contact member 22 with peripheral contact portions 24 made of electrically conductive silver, or an alloy including silver, is arranged adjacent to the plate 18. The peripheral ends of the contact portions 24 rest against the inner wall of the metallic housing 10.

The open end of the housing 10 is closed by the insulator 28 of ceramics and by the inwardly bent stop edge 26. The compound sealer 36 of synthetic resin provides a hermetic seal thereby securing the metallic housing 10, the insulator 28, and the second lead-in wire 30 passing through the insulator 28 in an airtight structure. The head portion 32 of the lead-in wire 30 is in contact with the contact member 22 when the second compression spring 34 which is inserted in the housing 10, is compressed between the slidable resilient contact member 22 and the insulator closure 28 under the force of the first compression spring 20. In other words, the hollow cavity 42 of the pellet 40, which is an important feature of the present invention, serves to accelerate the melting or fusing of the pellet when the temperature of the housing rises to a given point.

The first feature of the present invention is that the temperature sensitive pellet 40 is provided with cavity means 42, such as a hollow 42 at the central portion of the pellet. Such cavity means 42 provides a large shrinkage in volume when the pellet melts, whereby material necessary for making the pellets is saved. Preferably, the sectional area of the cavity means 42 is in the range of 5 to 50 percent, more specifically within the range of 20 to 30 percent of the whole cross sectional area of the pellet 40 of FIG. 4.

Since the above thermal fuse is connected in series with an electrical apparatus, not shown, and since the fuse is located at the temperature rising portion thereof, the pellet 40 will melt when the temperature of such electric apparatus abnormally rises in excess of the melting point of the temperature sensitive pellet 40, whereby the circuit is interrupted and over-heating of the apparatus is prevented. Thus, a fire may be avoided.

FIG. 3 shows the fuse after the pellet 40 has fused or melted. The molten material 44 undergoes a substantial reduction in volume compared to its original solid state size due to the cavity 42. The melting pellet material 44 simultaneously flows out towards the first compression spring 20 through a gap between the inner wall of housing 10 and the metallic plates 16 and 18. When the first compression spring 20 is released from the restriction of the contact pressure force due to the reduced volume of the temperature sensitive pellet material, the second compression spring 34 will expand. As a result, the metallic plates 16 and 18, the first compression spring 20 inserted therebetween, and the slidable resilient contact member 22 are moved leftward in FIG. 3, so that the contact member 22 leaves the head portion 32 of the inner end of the second lead-in wire 30. Therefore, the non-conductive spacing between the contact member 22 and the head portion 32 opens the circuit between the wires 12 and 30. The thermal fuse of the invention has the advantage that when the temperature of the environment becomes abnormal, e.g., above the allowable limit, the pellet 40 may rapidly and exactly fuse due to the cavity 42 at the center and causes a larger shrinkage in volume, whereby the contact member 22 can leave the head portion 32 of the second lead-in wire 30 without a spark generation due to a rapid departure speed. A wide gap between the resilient contact member 22 and the head portion 32 of the second lead-in wire 30 provides for a desired high breakdown voltage.

Another feature of the present invention is that the temperature sensitive pellet is so made as to be porous by using a material comprising an organic substance as used hitherto, but mixed with an inorganic substance having a superior thermal conductivity and also a superior electric insulation, whereby the thermal conductivity and the electric insulating ability of the pellet 40 is increased. Thus, first the organic substance with a low melting point and the inorganic substance with a superior thermal conductivity and a superior electric insulation are separately pulverized into powders of small particles. The powder of the inorganic substance is then added to the powder of the organic substance in an amount ranging from 5 percent to 50 percent. The powders are intimately mixed together for uniform distribution and the mixture is then pressure molded, for example, into the cylindrical pellet of a desired form. Examples for organic materials for the temperature sensitive pellet 40 are fructose, glucose, and salcylic acid, etc. The inorganic component may comprise alumina, quartz, silica, fluorite, etc. These compounds are only typical examples and the present invention is not limited to these examples, but other compounds having the mentioned characteristic properties of good thermal conductivity and high electrical insulating ability may be used.

Furthermore, the mixing ratio between the inorganic substance and the organic substance is determined from two standpoints. That is, first one must consider, whether it is possible to pressure mold the powder mixture into pellets of any desired shape. Second, it is necessary to known whether the pellet of organic and inorganic substances will become amorphous when the pellet melts.

The action of the fuse will be essentially the same as described above with the added advantage of a more rapid, more precise, and more certain operation. Thus, when the environmental temperature begins to increase and reaches the melting temperature of the fuse, the temperature sensitive pellet 40 will melt between the two copper plates 16 and 18, whereby the first spring 20 is released from the compression force which makes it possible for the second spring 34 to push the contact member 22 away from the second lead-in wire 30 by the spring force accumulated in the spring 34 and to interrupt the contact between the contact member 22 and the second lead-in wire 30, whereby the circuit is interrupted. According to the invention, the temperature sensitive pellet 40 melts substantially instantly when the predetermined, critical breakdown temperature is reached because of the rapid transmittal of the thermal energy through the inorganic particles uniformly distributed in the pellet. The thermal energy is supplied from the outside through the cylindrical housing 10. The organic substance has a tendency to melt instantly when its melting point is reached. Furthermore, when the temperature sensitive pellets are prepared, as shown in FIG. 2, so as to have cavity means therein, they occupy only a small volume in the molten state. Therefore, since the contact member 22 is able to move promptly and moreover, its traveling distance is also large, sparks do not appear between the slidable contact member 22 and the lead-in wire 30. The electrical resistance to the potential between the elements 22 and 32 is large and accordingly, a definite circuit interruption is accomplished. The above explanation describing the fuse action from "on" to "off", applies substantially also when the fuse acts from "off" to "on". In any event, the present pellet is suitable for use in both types of fuses and such fuses may be used in various machines and tools of all kinds requiring a respective fuse action.

Since the pellet of the thermal fuse of the present invention is prepared by a molding treatment using a mixture of an organic material in a powder state and a pulverized inorganic material which is superior in thermal conductivity and also in its electric insulation qualities, the present temperature sensitive pellet is capable of uniformly and rapidly transmitting the thermal energy entering from the outside through the housing 10, into the center of the pellet, whereby the pellet melts instantly throughout the whole body of the temperature sensitive pellet. Thus, the fuse action at the critical temperature is prompt and satisfactory. Since the contact between the contact member and the head of the second lead-in wire is released rapidly with the instantaneous melting of the temperature sensitive pellet, sparking is prevented when the circuit is interrupted. Further, since the electric resistance to the applied potential difference between the movable contact plate and the lead-in wire becomes very large after the action of the fuse, the break-down of the circuit is certain.

The manufacturing of the thermal fuse of the present invention will now be described. The first lead-in wire 12 is first secured or sealed into the metallic housing 10. The circuit breaker pellet 40 is then inserted into the housing, followed by the metallic plate 16, the first compression spring 20, the metallic plate 18, and the slidable resilient contact member 22 which may be prepared in a manner as disclosed in the copending application Ser. No. 752,725 filed Dec. 21, 1976, assigned to the same assignee. Second, the contact member 22 inserted in the housing 10, is accurately centrally located so as to contact the second compression spring 34 secured to the insulator 28, which is also secured by means of the bent end flange 26 of the housing 10.

In view of the above description of the present invention, it will be appreciated that the pellet 40 is provided with cavity means. Therefore, when the temperature rises to the critical temperature, the pellet 40 melts and reduces its volume significantly, and the quick release of the contact member from the head portion of the inner end of the second lead-in wire eliminates the generation of a spark. Also, the spacing between the contact member after its motion and the head portion of the second lead-in wire is made to effectively raise the breakdown voltage. The reliability of the present thermal fuse is greatly improved not only because of the higher thermal conductivity of the pellet by the addition of inorganic materials, but also because of the larger shrinkage in volume due to the cavity means. Another advantage of the present invention is the low cost of the temperature sensitive pellet since the pellet is provided with said cavity means, whereby material is saved and also because the pellet is prepared by using inorganic materials as a mix-in component which is cheaper than any organic compound used above in conventional temperature sensitive pellets.

FIGS. 5 and 6 show other embodiments of the pellet, according to the invention, in which the cavities 46, 48 and 50 of the pellet are closed in order to mechanically reinforce the pellet. FIGS. 7 to 10 show modifications of the cavity means, whereby cavities 52, 54, 56 and 58 are provided. In these modifications, the pellet 40 is prepared by using inorganic materials as disclosed herein.

Although the invention has been described with reference to specific example embodiments, it is to be understood that it is intended to cover all modifications and equivalents within the scope of the appended claims.

What is claimed is:

1. A temperature responsive electric fuse comprising an electrically and thermally conductive housing having an open-ended portion, first conductor means secured to said housing, switch means located in said housing in a certain order, said switch means including a temperature sensitive pellet fusible at a predetermined temperature, a first metallic retaining plate, a first compression spring, a second metallic retaining plate, a slidable resilient contact member, and a second compression spring, an insulator closing said open-ended portion of said housing, second conductor means including lead-in wire means passing through said insulator and having a contact portion at the inner end thereof, and hermetical sealing means of insulating material integrally secured to said housing, to said insulator and to said second conductor means so as to electrically couple said first conductor means to said second conductor means through said resilient contact member, said pellet comprising means for accelerating the fuse action of the pellet to increase the reliability of the fuse when the temperature of said housing rises to a given point.

2. The fuse of claim 1, wherein said fuse action accelerating means comprise cavity means in said pellet, whereby a larger volume shrinkage of said pellet is achieved when the pellet fuses.

3. The fuse of claim 2, wherein said pellet has a cylindrical shape and said cavity means is a hollow center portion having a cross-sectional area ranging from about 5 to about 50 percent of the cross-sectional area.

4. The fuse of claim 1, wherein said pellet is made of an organic substance and wherein said fuse action accelerating means is an inorganic substance added to the organic substance of said pellet, said inorganic substance having a higher thermal conductivity and electrical insulation to cause a rapid fusion of said pellet when the temperature of the housing rises to a given point.

5. The fuse of claim 4, wherein said inorganic substance ranges from 5 percent to 50 percent by weight of said organic substance.

6. The fuse of claim 2, wherein said pellet comprises a mixture of organic material having a melting point at a given temperature and of inorganic material having a higher thermal conductivity than said organic material to cause rapid fusion of said pellet when the temperature rises to said melting point.

* * * * *